US006123022A

United States Patent [19]

Takata

[11] Patent Number: 6,123,022

[45] Date of Patent: Sep. 26, 2000

[54] STENCIL PRINTING MACHINE

[75] Inventor: Atsushi Takata, Ibaraki-ken, Japan

[73] Assignee: Riso Kagaku Corporation, Tokyo, Japan

[21] Appl. No.: 09/425,219

[22] Filed: Oct. 22, 1999

[30] Foreign Application Priority Data

Oct. 26, 1998 [JP] Japan ..... 10-304175

[51] Int. Cl.[7] ..... B41L 13/18

[52] U.S. Cl. ..... 101/119; 101/116

[58] Field of Search ..... 101/119, 116, 101/115, 114, DIG. 45; 399/4, 159, 110

[56] References Cited

U.S. PATENT DOCUMENTS

| | | | |
|---|---|---|---|
| 4,030,409 | 6/1977 | Adhikari et al. | 101/47 |
| 4,044,671 | 8/1977 | Hou et al. | 101/116 |
| 4,088,800 | 5/1978 | Nicholson | 101/423 |
| 5,185,644 | 2/1993 | Shimoyama et al. | 101/DIG. 45 |
| 5,443,557 | 8/1995 | Hasegawa | 101/119 |
| 5,507,225 | 4/1996 | Noguchi et al. | 101/116 |
| 5,537,920 | 7/1996 | Hasegawa et al. | 101/119 |
| 5,699,731 | 12/1997 | Hara | 101/119 |

FOREIGN PATENT DOCUMENTS

| | | | |
|---|---|---|---|
| 0 805 048 | 11/1997 | European Pat. Off. . | |
| 2633062 | 12/1989 | France | 101/116 |

*Primary Examiner*—John S. Hilten
*Assistant Examiner*—Anthony H. Nguyen
*Attorney, Agent, or Firm*—Kanesaka & Takeuchi

[57] ABSTRACT

A stencil printing machine includes a printing drum rotationally driven around a central axis thereof and adapted to receive a perforated stencil sheet around an outer circumferential surface thereof, an ink container detachably attached to the printing drum, the ink container having ink therein, an ink supplying device situated inside the printing drum to be seen through an opening formed in the printing drum when the ink container is detached from the printing drum, the ink supplying device supplying the ink to an inner circumferential surface of the printing drum, and a lightening device for lightening the ink supplying device when the ink container is detached from the printing drum.

4 Claims, 9 Drawing Sheets

STENCIL PRINTING MACHINE

BACKGROUND OF THE INVENTION

1. Field of the Invention

The present invention relates to a stencil printing machine wherein printing is conducted by a printing drum having a stencil sheet wrapped thereon. More specifically, the stencil printing machine is such that an ink container detachably attached to the printing drum is lightened by lightening means to facilitate maintenance operation.

2. Description of the Related Art

FIG. 7 is a perspective view illustrating a printing drum detachably attached to a stencil printing machine.

After a front cover of the stencil printing machine is opened, the printing drum 50 is mounted therein. An ink container 51 is detachably attached to an approximately center position inside the printing drum 50. The ink container 51 stores ink therein.

FIG. 8 is a perspective view illustrating a constitution of ink supplying means 55 in the printing drum 50. This drawing is a view seen in a direction approximately opposite to that of FIG. 7, namely having a viewpoint in a rear side of the machine.

An ink motor 56 sucks ink stored in the ink container 51 and supplies the ink onto a squeegee roller 58 through plural holes formed in a tube-like distributor 57.

A doctor roller 59 is situated adjacent to the squeegee roller 58 at a small distance, i.e. a gap, away from the squeegee roller.

As shown in a front view of FIG. 9, the ink is accumulated to a predetermined quantity between the squeegee roller 58 and the doctor roller 59, thereby forming an ink swirl "A" with a uniform thickness while being rotated by a mixing shaft 60 situated therein.

The ink is conveyed along a circumferential surface of the squeegee roller 58 and supplied to an inner surface of the printing drum 50 contacting the squeegee roller 58, and then allowed to pass through the drum to transfer to an outer surface. Around the outer surface of the printing drum, a stencil sheet perforated according to an image is wrapped. The ink passes through perforations of the stencil sheet to transfer onto a printing sheet, thereby forming a predetermined image thereon.

The ink supplying means 55 has an ink sensor 63 used for stabilizing ink supply from the ink container 51.

The ink sensor 63 is attached to a board 65 situated above the ink swirl "A" inside the printing drum 50. The ink sensor 63 has two needle-shaped electrodes, a long one 63*b* and a short one 63*a*, each extending downwards from the board 65 for detecting quantity of the ink.

When the ink is supplied to the printing drum 50 through the squeegee roller 58 during printing, suction by the ink motor 56 is controlled so that quantity of ink in the ink swirl "A" is kept constant while being detected by the electrode 63*b* or 63*a* between two end-points thereof.

As described above, the ink supplying means 55 is situated inside the printing drum 50. Consequently, the ink container 51 must be detached from the printing drum when an operator is required to see a position of the ink swirl "A" in order to conduct a performance test of the ink supplying means 55 during assembling the machine and an in-serve maintenance operation. And, the operator is forced to see the position through a narrow access opening comparable to a diameter of the ink container 51.

Conventionally, the operator manages to conduct the maintenance operation, lightening the position by a flashlight from outside the machine; however, lightening the position is difficult to conduct properly, and the operation itself is not easy since one hand of the operator is occupied by the flashlight. Further, temperature inside the printing drum 50 is expected not to fluctuate as long as possible. Namely, fluctuation of the temperature inside the printing drum 50 changes viscosity of the ink, thereby finally affecting printing quality.

The present invention is made to solve the aforementioned problems. An object of the present invention is to provide a stencil printing machine such that an operator can see the inside of the printing drum easily without affecting temperature thereof, and a life-time of lightening means for lightening a position to be checked can be effectively used.

SUMMARY OF THE INVENTION

A stencil printing machine as defined in a first aspect of the present invention comprises a printing drum rotationally driven around a central axis thereof and adapted to receive a perforated stencil sheet around an outer circumferential surface thereof; an ink container detachably attached to the printing drum, the ink container having ink therein; ink supplying means situated inside the printing drum to be seen through an opening formed in the printing drum when the ink container is detached from the printing drum; the ink supplying means supplying the ink to an inner circumferential surface of the printing drum; and lightening means for lightening the ink supplying means when the ink container is detached from the printing drum.

According to a stencil printing machine as defined in a second aspect of the present invention, in the stencil printing machine of the first aspect, the ink supplying means comprises a board and a temperature sensor situated on the board for detecting temperature of the ink, and the lightening means is attached to the board.

A stencil printing machine as defined in a third aspect of the present invention, in the stencil printing machine of the first aspect, further comprises an ink container detecting means for detecting whether the ink container is attached to the printing drum, and a controller for switching the lightening means upon detection of the ink container by the ink container detecting means.

A stencil printing machine as defined in a fourth aspect of the present invention, in the stencil printing machine of the third aspect, farther comprises a front cover openably attached to the stencil printing machine for covering the printing drum, and cover detecting means for detecting opening and closing of the front cover, wherein the controller operates said lightening means to turn on when the cover detecting means detects opening of the front cover and the ink container detecting means detects detachment of the ink container from the printing drum, and the controller operates the lightening means not to turn on when the cover detecting means detects closing of the front cover or the ink container detecting means detects attachment of the ink container to the printing drum.

According to the constitution described above, the ink supplying means situated inside the printing drum can be seen by an operator if the ink container is detached from the printing drum. Since the lightening means is situated to the ink supplying means, maintenance and checking operation can be easily conducted.

The lightening means is energized only when necessary, namely in a period when the front cover is opened and the ink container is detached. That improves a lifetime of the lightening means and prevents an inner temperature from rising.

DETAILED DESCRIPTION OF PREFERRED EMBODIMENTS

Figure 1:
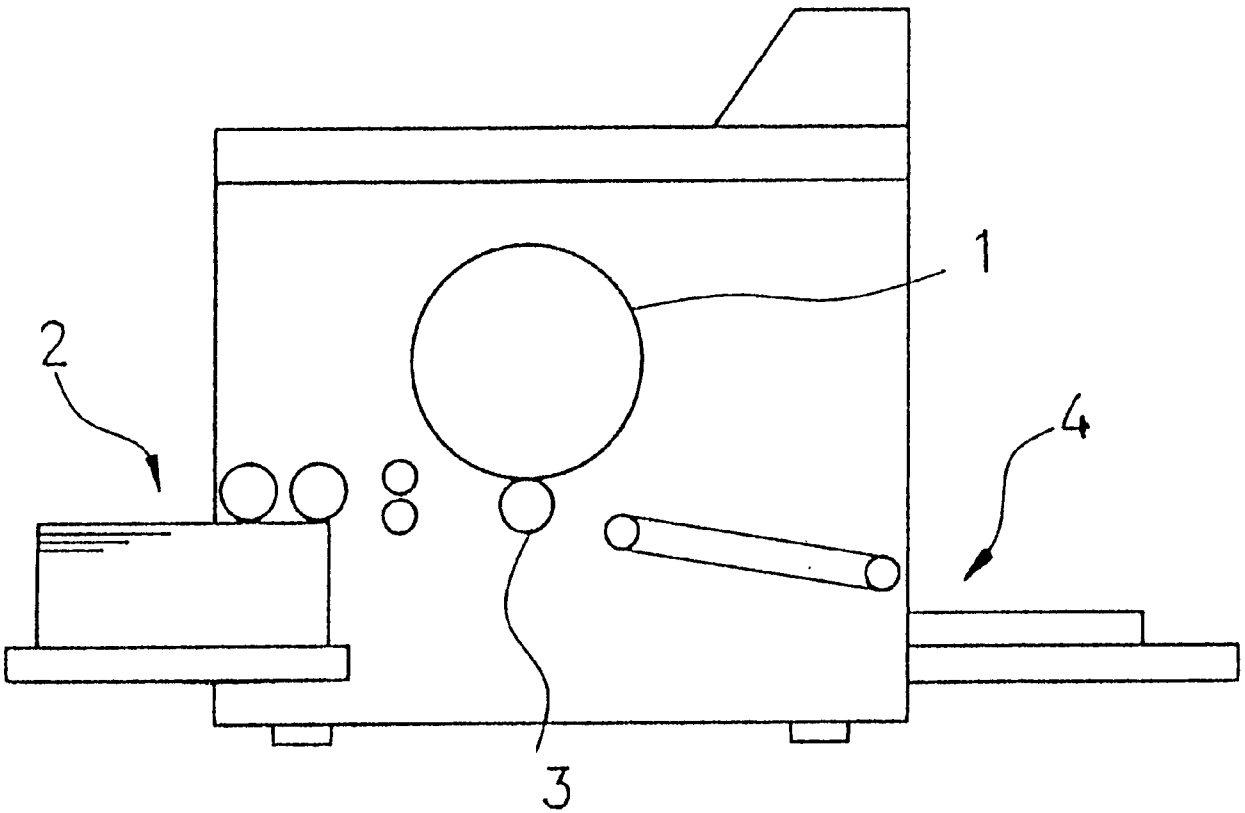
FIG. 1 is a front view illustrating the entire constitution of a stencil printing machine of the present invention.

Hereafter, a preferred embodiment of a stencil printing machine according to the present invention will be explained. FIG. 1 is a front view illustrating the stencil printing machine.

A stencil sheet perforated according to an image is wrapped around an outer circumferential surface of a printing drum 1. A printing sheet 2 supplied from a sheet supplying section 2 is conveyed between the printing drum 1 and a press roller 3 contacting thereto by rotation of the printing drum 1. The press roller 3 presses the printing sheet against the printing drum 1. Ink supplied from an inside of the printing drum passes through perforations of the stencil sheet, and then transfers onto the printing sheet, thereby forming an image thereon. After printed, the printing sheet is discharged to a sheet discharge section 4.

Figure 2:
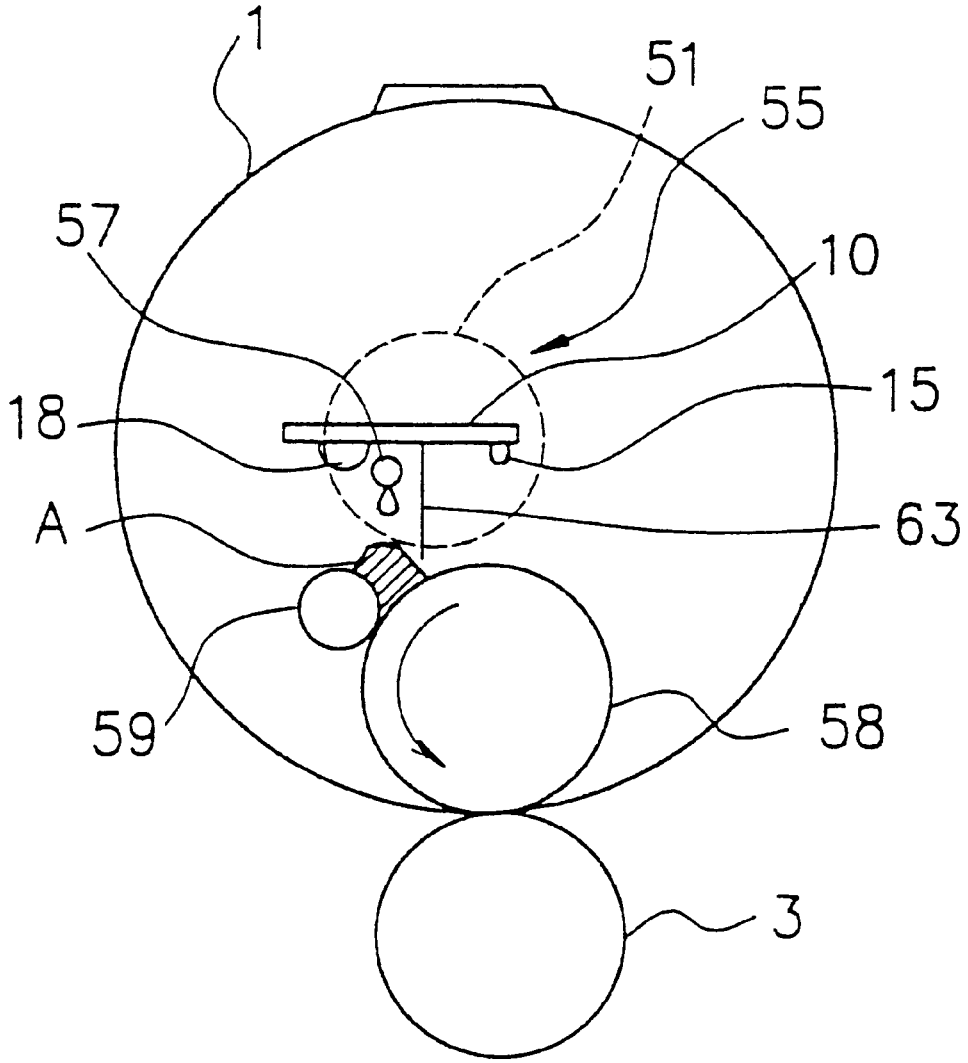
FIG. 2 is a front view illustrating a printing drum of the machine.
Figure 3:
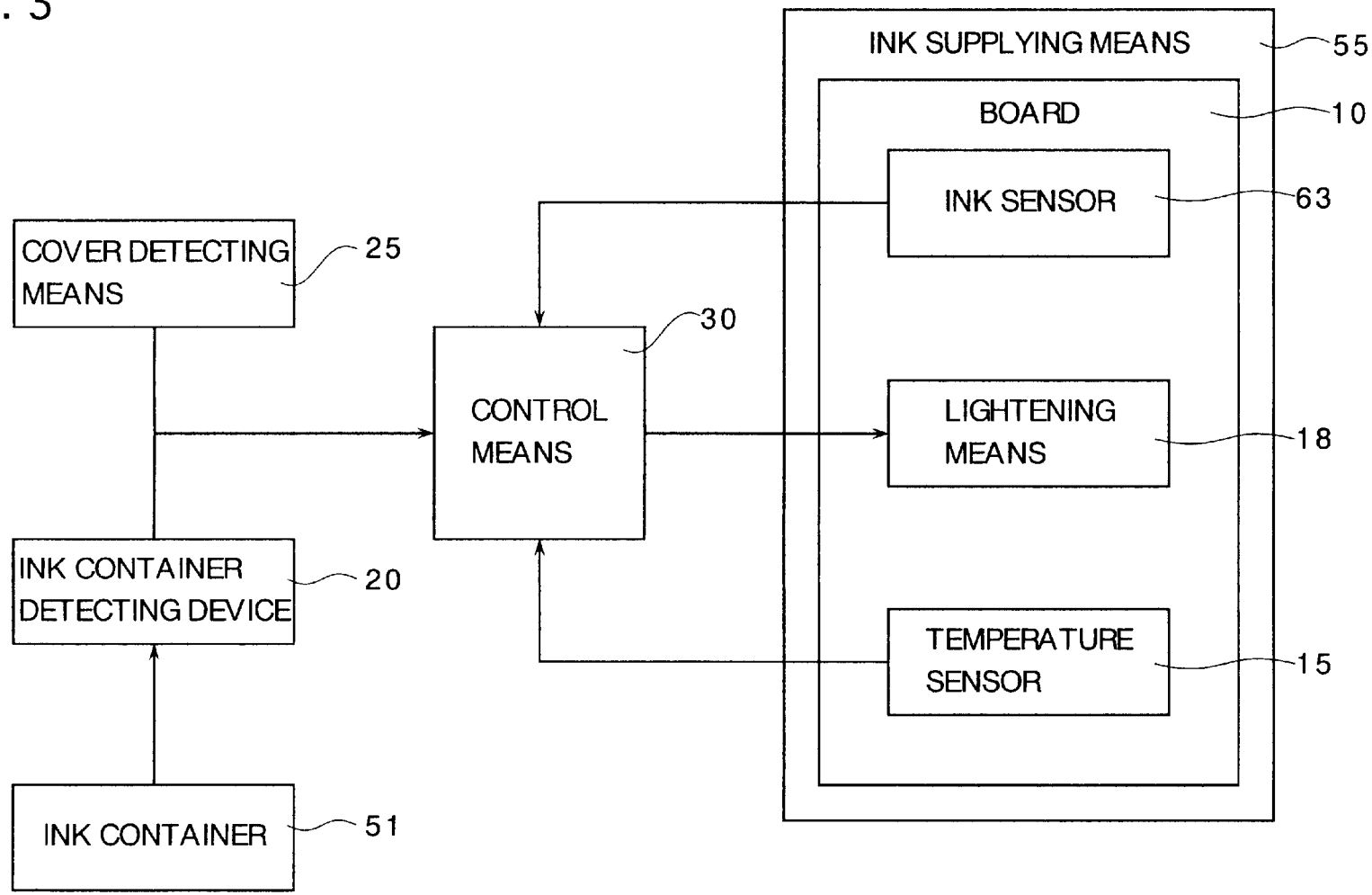
FIG. 3 is a block diagram showing an electrical constitution of the machine.

FIG. 2 is a front view illustrating an inside of the printing drum. FIG. 3 is a block diagram showing an electrical constitution of the stencil printing machine.

Inside the printing drum 1, the ink supplying means 55 as explained above is situated. Ink is dropped from the distributor 57, accumulating to a predetermined quantity between the squeegee roller 58 and the doctor roller 59, thereby forming an ink swirl "A" with a uniform thickness while being rotated by a not-shown mixing shaft situated therein.

The ink sensor 63 is attached to a board 10 situated above the ink swirl "A" inside the printing drum 1. The board 10 is fixedly arranged at a required position. The ink sensor 63 as described before, a temperature sensor 15, and lightening means 18 are attached to the board 10. The board 10 is formed small to save space; therefore, the ink sensor 63, the temperature sensor 15, and the lightening means 18 are arranged thereon adjacent to each other.

The ink sensor 63 has two needle-shaped electrodes, a long one and a short one, each extending downwards from the board 10 for detecting quantity of the ink in the ink swirl "A". The electrodes output a detecting signal into control means 30 disposed inside the machine but outside the printing drum 1. When the ink is supplied to the printing drum 1 by the ink supplying means 55 during printing, the control means 30 controls suction by the ink motor so that quantity of ink in the ink swirl "A" is kept constant while being detected by the electrodes between two end-points thereof.

The temperature sensor 15 includes a thermistor, and detects temperature inside the printing drum 1 to output a temperature signal into the control means 30. Viscosity of ink changes according to temperature, and change in viscosity of ink affects printing quality. In the embodiment, atmospheric temperature inside the printing drum 1 is regarded as temperature of the ink, and outputted into the control means 30.

The control means 30 controls pressing force of the press roller 3 according to temperature of the ink. In this way, uniform printed matter can be obtained in spite of fluctuation of temperature.

The lightening means 18 includes an incandescent ramp, and emits white light towards the ink swirl "A". Lightening by the lightening means 18 clearly show a state of the ink swirl "A", thereby facilitating maintenance operation of the machine. On-off operation of the lightening means 18 is controlled by the control means 30.

Light color of the lightening means 18 is preferably white for facilitating recognition of ink color. Other lightening device can be adopted for the lightening means 18 provided that it enables an operator to see the inside of the printing drum easily. Hereinafter, a constitution such that a general-purpose incandescent ramp is used will be explained.

Figure 7:
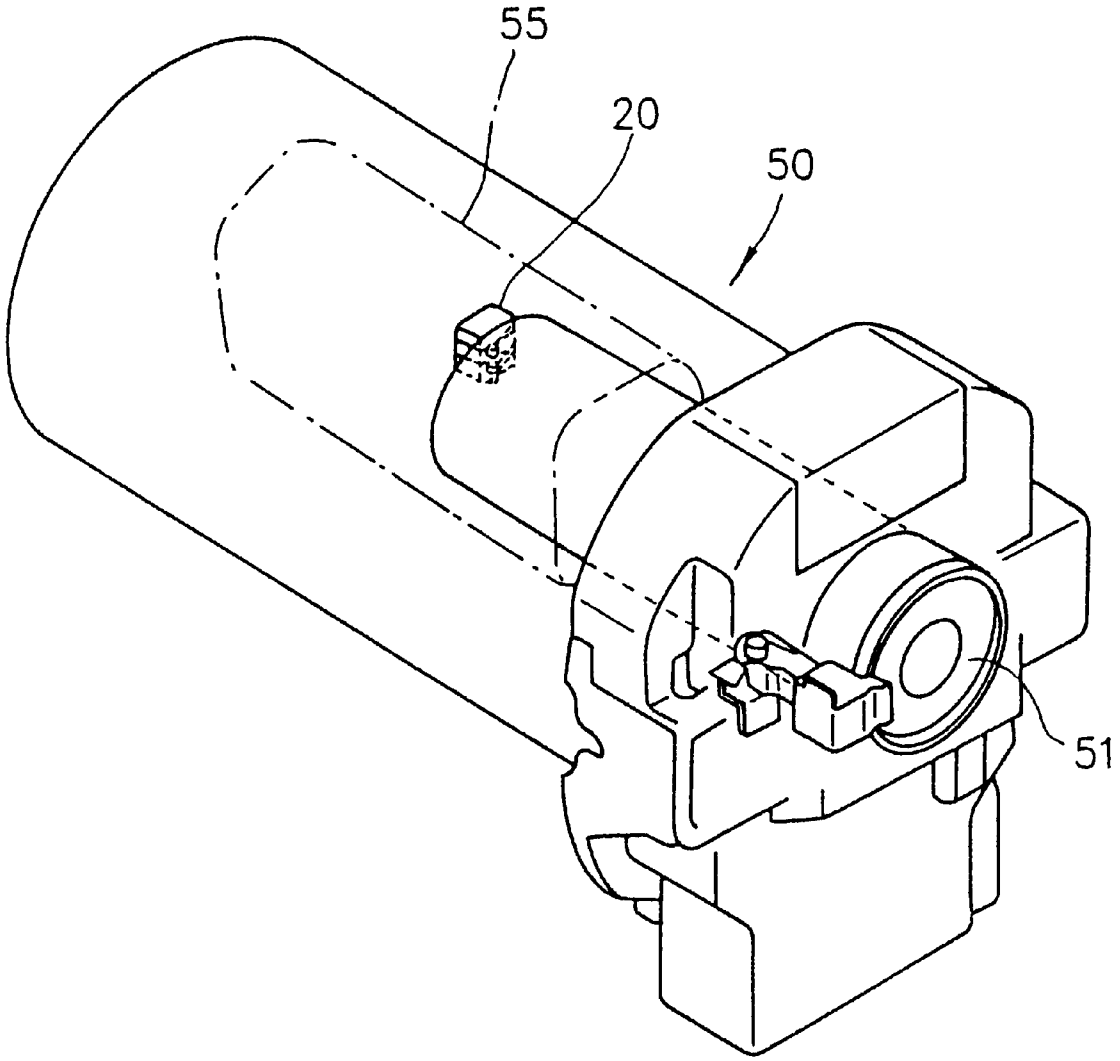
FIG. 7 is a perspective view illustrating the printing drum.
Figure 8:
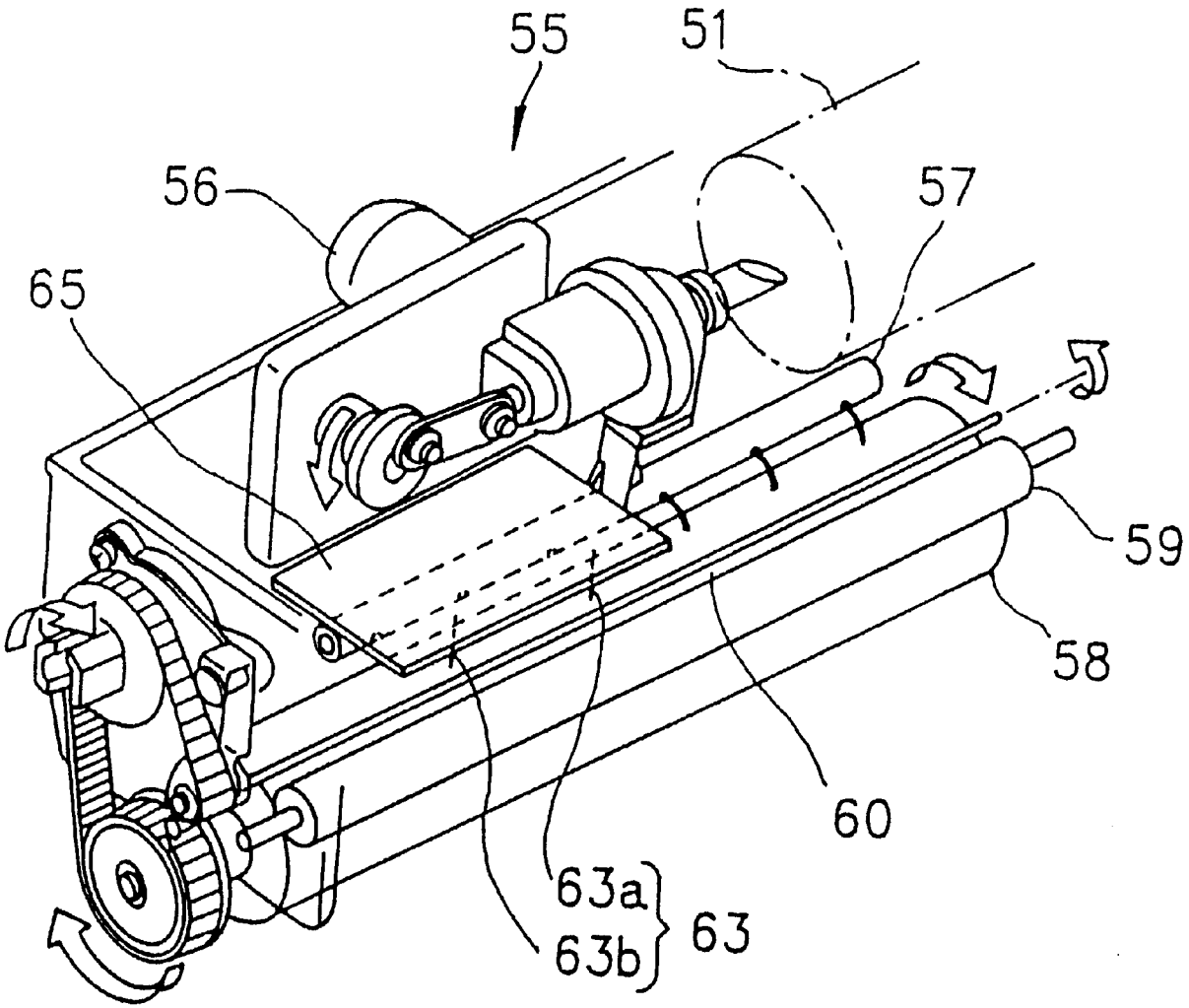
FIG. 8 is a perspective view illustrating ink supplying means.
Figure 9:
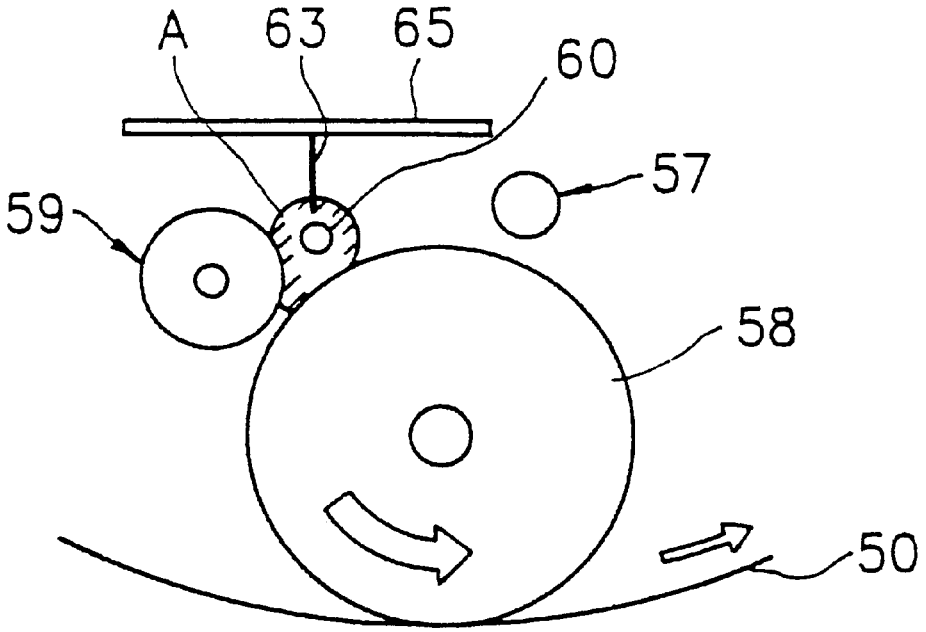
FIG. 9 is a partially enlarged front view illustrating the ink supplying means.

The ink container 51 is inserted into the printing drum 1 from a front side of the machine and detachably attached thereto. As illustrated in FIG. 7, the printing drum 1 has an ink container detecting device 20 therein. The ink container detecting device 20 outputs a signal indicating whether the container is attached to the drum, and the signal is received by the control means 30. As illustrated in FIG. 7, the ink container detecting device 20 may be a micro-switch switching a contact thereof according to attachment and detachment of the ink container 51.

Figure 4:
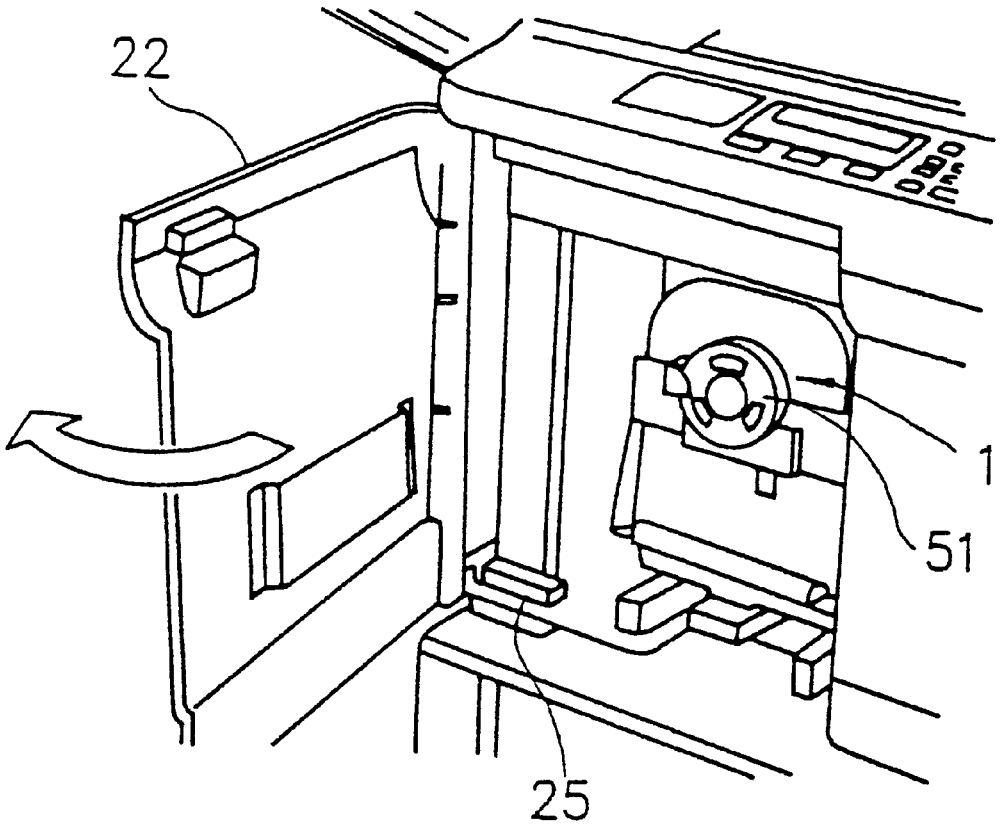
FIG. 4 is a perspective view of the machine.

FIG. 4 is a perspective view of the machine. A front cover 22 is provided to the front side of the machine adjacent to the printing drum 1. When the front cover 22 is opened, various maintenance operations such as checking the printing drum 1, attachment and detachment of the ink container 51, and checking the ink swirl "A" can be conducted.

A cover detecting means 25 is provided to the machine for detecting opening and closing of the front cover 22. The cover detecting means 25 outputs a signal indicating a state of the front cover 22, and the signal is received by the control means 30. The cover detecting means 25 also may be a micro-switch.

The control means 30 controls perforating and printing operation, and switching of the lightening means 18. The control of switching the lightening means 18 is conducted based on the signals inputted from the ink container detecting device 20 and the cover detecting means 25.

Figure 5:
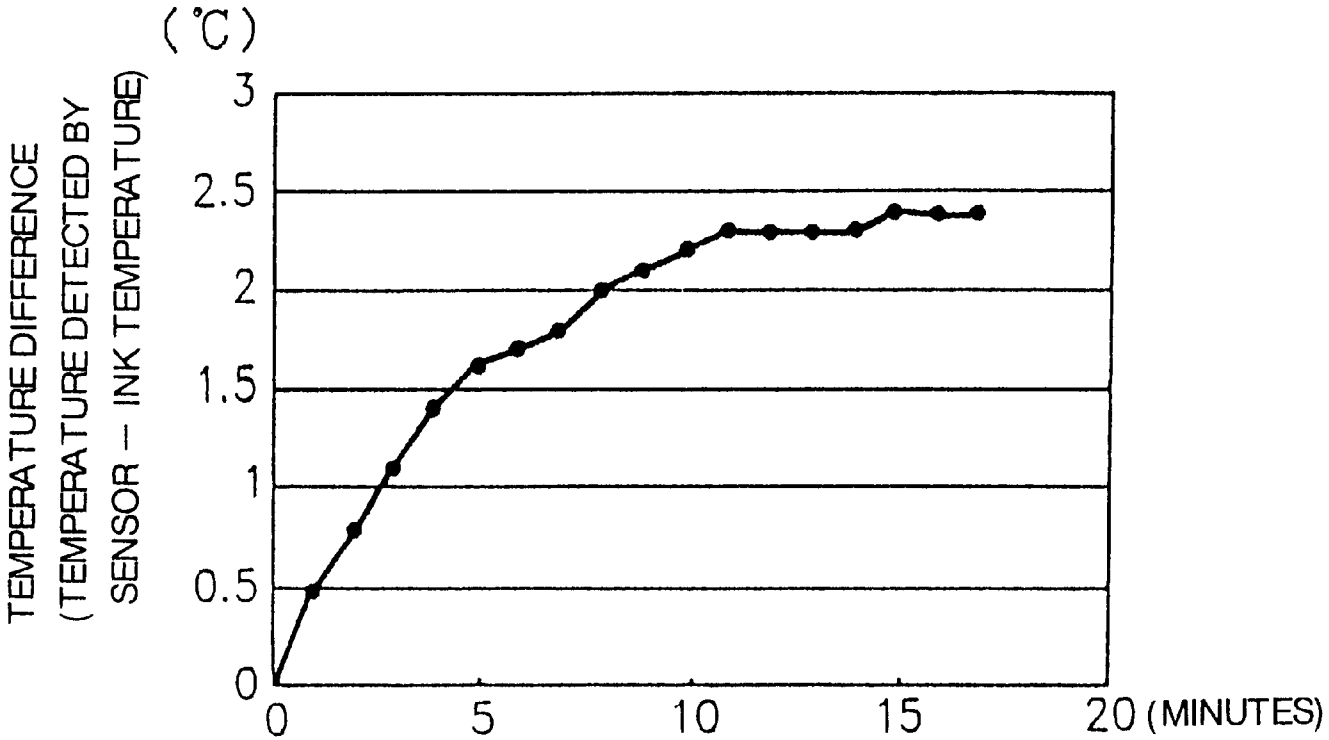
FIG. 5 is a graph showing temperature difference, when lightening means is energized, between temperature detected by a temperature sensor and actual temperature of ink.

FIG. 5 is a graph showing a relation between elapsed time after lightening means is energized and temperature difference between temperature detected by a temperature sensor and actual temperature of the ink.

The lightening means 18 is an incandescent ramp, and it emits heat when energized. The heat emitted affects the temperature sensor 15 situated to the board 10 adjacent to the lightening means 18. But, the ink in the ink swirl "A" has a high specific heat capacity.

Experimental results reveal that temperature difference between temperature detected by the temperature sensor 15 and actual temperature of the ink increases as time passes, finally resulting in over 2° C.

Thus, in the case where the lightening means 18 continues to function for a long time, temperature detected by the temperature sensor 15 as temperature of the ink is different from actual one of the ink. And, the temperature sensor 15 outputs a signal according to the detected temperature into the control means 30. Accordingly, the control means 30 controls pressing force of the pressing roller based on the detected temperature different from the actual temperature of the ink. That may deteriorates printing quality.

Therefore, it is preferable that the lightening means 18 is energized only when necessary.

Figure 6:
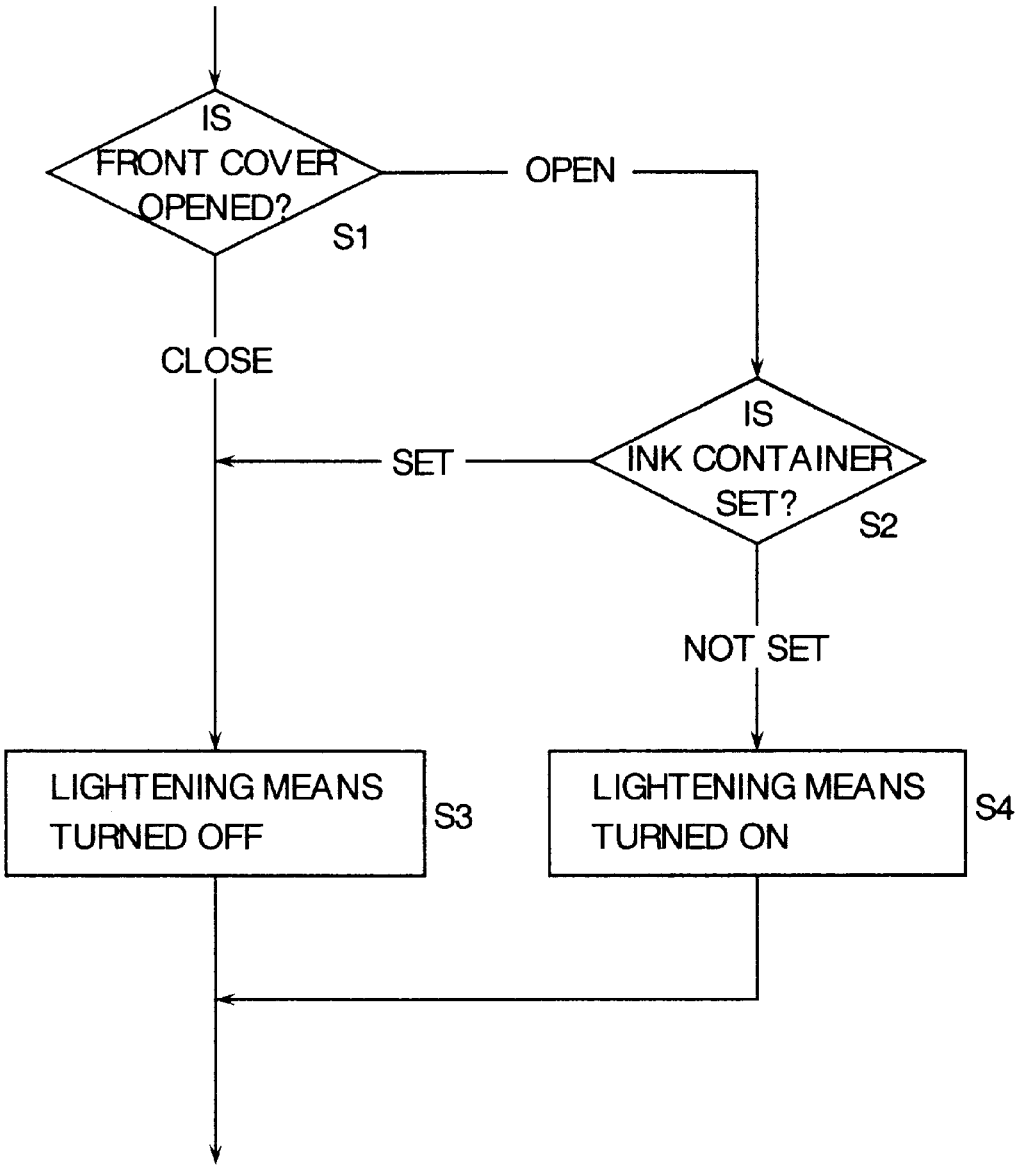
FIG. 6 is a flow chart showing lightening control of the lightening means.

FIG. 6 is a flow chart showing on-off control of the lightening means 18.

That control is conducted continuously and periodically at a predetermined interval as an interrupt control when a power supply of the stencil printing machine is switched on.

The lightening means 18 is selectively turned on or turned off according to opening or closing state of the front cover 22 and attachment or detachment of the ink container 51. Opening or closing state of the front cover 22 is detected by the cover detecting means 25. Attachment or detachment of the ink container 51 is detected by the ink container detecting device 20.

When the front cover 22 is opened as illustrated in the drawing at judgement "OPEN" of step S1 and the ink container 51 is detached at judgement "NOT SET" of step S2, the lightening means 18 is turned on at step S4.

Contrary to this, when the front cover 22 is closed at judgement "CLOSE" of step S1, the lightening means 18 is turned off at step S4.

Further, even in the case where the front cover 22 is opened at judgement "OPEN" of step S1, if the ink container 51 is attached to the drum at judgement "SET" of step S2, the lightening means 18 is turned off at step S3.

The lightening means 18 is lit only in the time when the front cover 22 is opened, the ink container 51 is detached, and then the ink swirl "A" can be seen.

Heat emitted from the lightening means 18 in maintenance operation escapes through the access opening out of the drum. Therefore, temperature difference between temperature detected by the temperature sensor and actual temperature of the ink can be decreased.

During the maintenance operation, the stencil printing machine can not conduct printing. Meanwhile, the control means 30 does not receive a detection signal from the temperature sensor 15. Even in the case where ink temperature is detected improperly under influence of the lightening means 18, printing is not conducted and printed matter with poor printing quality is not produced.

In the constitution as explained above, the control means 30 operates the lightening means 18 to turn off in a most part of operating time of the machine such as perforating or printing time.

Since the lightening means 18 is kept being turned off in such operating time of the machine, the temperature sensor 15 is not affected by heat of the lightening means 18. Accordingly, the temperature sensor 15 can properly detect temperature of the ink inside the printing drum 1, so that printing quality can be kept to a stable level without being deteriorated.

Further, the constitution as described above can cope with a rare case where the front cover 22 is closed when the ink container 51 is not attached. A simplified embodiment such that the lightening means 18 is operated only on the basis of attachment and detachment of the ink container 51 is also useful.

Further, functioning time of the lightening means 18 is fairly short relative to operating time of the machine. Therefore, lifetime of the incandescent lamp can be effectively used, thereby approaching that of the machine.

As described above, since the lightening means 18 is attached to a small space inside the printing drum 1, exchange of that conventionally requires time for disassembling the printing drum 1 and so on. But, according to the present invention, lifetime of the lightening means 18 can be effectively used since it is turned on only when necessary, so that frequency of the exchange decreases and time required for that can be shortened in total.

In the embodiment as explained above, the lightening means 18 is attached to the board 10, which the temperature sensor 15 is attached to. The lightening means 18 and the temperature sensor 15 may be attached to different boards. However, they are required to be arranged adjacent to each other in the small space to utilize it.

According to the present invention, the lightening means can lighten a necessary portion inside the printing drum for facilitating maintenance operation since it is situated inside thereof. In a narrow space inside the printing drum, the lightening means is attached to the same board as the temperature sensor is attached to. Accordingly, the necessary portion inside the drum can be appropriately lightened by the lightening means when examining the ink swirl and so on without providing an additional board for attachment of the lightening means.

Further, according to the constitution where the lightening means is turned on only when detachment of the ink container is detected, the temperature sensor can properly detect temperature of the ink since it is not likely to be affected by the lightening means situated adjacent thereto. That prevents printing quality from deteriorating and improves lifetime of the lightening means.

Further more, if such a constitution is adopted that the lightening means is turned on only when opening of the front cover as well as detachment of the ink container is detected, the lightening means can function only in a necessary time for the maintenance operation. That improves effects described above.

What is claimed is:

1. A stencil printing machine comprising:

a rotational printing drum, an ink container detachably attached to said printing drum, said ink container having ink therein, ink supplying means situated inside said printing drum, an inside of the printing drum being seen through an opening formed in said printing drum when said ink container is detached from said printing drum, said ink supplying means supplying said ink to an inner circumferential surface of said printing drum, and lightening means situated inside the printing drum for lightening said ink supplying means, said lightening means being turned on in a period that said ink container is detached from said printing drum.

2. A stencil printing machine as claimed in claim 1, wherein said ink supplying means comprises a board and a temperature sensor situated on said board for detecting temperature of said ink, and said lightening means is attached to said board.

3. A stencil printing machine as claimed in claim 1, further comprising ink container detecting means for detecting whether said ink container is attached to said printing drum, and a controller for switching said lightening means upon detection of said ink container by said ink container detecting means.

4. A stencil printing machine as claimed in claim 3, further comprising a front cover openably attached to said stencil printing machine for covering said printing drum, and cover detecting means for detecting opening and closing of said front cover, said controller operating said lightening means to turn on when said cover detecting means detects opening of said front cover and said ink container detecting means detects detachment of said ink container from said printing drum, and said controller operating said lightening means not to turn on when said cover detecting means detects closing of said front cover or said ink container detecting means detects attachment of said ink container to said printing drum.

* * * * *